US008590473B1

(12) United States Patent
Caccamo et al.

(10) Patent No.: US 8,590,473 B1
(45) Date of Patent: Nov. 26, 2013

(54) SAFETY CATCH FOR LAUNCH AND RECOVERY

(75) Inventors: Matthew P Caccamo, Virginia Beach, VA (US); Steve A Brandis, Virginia Beach, VA (US); James V Harwell, Norfolk, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 133 days.

(21) Appl. No.: 13/073,075

(22) Filed: Mar. 28, 2011

Related U.S. Application Data

(60) Provisional application No. 61/365,800, filed on Jul. 20, 2010.

(51) Int. Cl.

| | |
|---|---|
| ***B63B 17/00*** | (2006.01) |
| ***B63B 35/00*** | (2006.01) |
| ***B63C 3/02*** | (2006.01) |
| ***B63C 3/08*** | (2006.01) |
| ***B63C 3/10*** | (2006.01) |
| ***B63C 3/14*** | (2006.01) |

(52) U.S. Cl.
USPC ..... 114/258; 114/343; 405/1

(58) Field of Classification Search
USPC ..... 114/44, 258–263, 284–287, 343, 344, 114/375; 280/414.1; 292/121–129; 405/1–7; 410/69, 77, 80
See application file for complete search history.

(56) References Cited

U.S. PATENT DOCUMENTS

| | | | | |
|---|---|---|---|---|
| 1,007,398 | A * | 10/1911 | Snider | 292/129 |
| 3,210,038 | A * | 10/1965 | Bader et al. | 410/77 |
| 3,282,550 | A * | 11/1966 | Warren | 410/77 |
| 4,603,239 | A | 7/1986 | Ishii | |
| 4,682,560 | A * | 7/1987 | Lieb et al. | 114/343 |
| 4,875,883 | A | 10/1989 | Slattery | |
| 4,927,194 | A | 5/1990 | Wagner | |
| 5,769,517 | A | 6/1998 | Carde | |
| 6,779,475 | B1 | 8/2004 | Crane et al. | |
| 6,843,198 | B1 | 1/2005 | Witbeck | |
| 7,156,036 | B2 | 1/2007 | Seiple | |

* cited by examiner

*Primary Examiner* — Ajay Vasudeva
(74) *Attorney, Agent, or Firm* — Dave A. Ghatt

(57) ABSTRACT

One of more safety catches attachable to water vessels for preventing rollback during launch and recovery operations. Each safety catch includes a pivotally attached catch arm for mating with a notched groove in an inclined surface to prevent the rollback.

13 Claims, 9 Drawing Sheets

SAFETY CATCH FOR LAUNCH AND RECOVERY

CROSS-REFERENCE TO RELATED APPLICATIONS

This application claims the benefit of U.S. Provisional Application No. 61/365,800, filed Jul. 20, 2010, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a locking safety catch attachable to a water vessel for launching and recovery operations on an inclined surface, the locking safety catch working in conjunction with a notched groove in the inclined surface to prevent rollback of the water vessel.

BACKGROUND

The recovery of smaller surface water vessels, such as manned or unmanned surface water vessels (USVs), by larger parent ships or on land structures is an emerging technology. Once recovered by the parent ship, servicing operations such as fueling and general maintenance may be performed. Traditionally, the recovery of a smaller vessel is accomplished by driving the smaller vessel alongside a stationary parent ship or structure and lifted by davit into the ship or structure. Alternatively, the smaller water vessel may be driven up a ramp into the larger ship. Ramps are also used to facilitate launching operations where the manned or unmanned surface water vessels are launched into the water.

In launch and recovery operations, the water vessel is typically captured by rope or lanyards attached to the parent ship or structure. There are inherent risks associated with the launch and recovery of water vessels up and down ramps. Water vessels may be manned or unmanned aluminum boats that weigh about 20,000 lbs. Any uncontrolled slippage of a water vessel during a launch or recovery operation places operators at jeopardy, and may result in damage to the water vessel or the parent ship or the structure on which the water vessel is loaded. The prior art does not teach an operator-friendly apparatus that prevents rollback, and the adverse effects associated with the rollback of vessels being launched or recovered.

SUMMARY

In one aspect, the invention is a safety catch. The safety catch includes a mounting bracket, and a first support member attached to the mounting bracket. The safety catch also includes a second support member attached to the mounting bracket, with the first and second support members forming a groove therebetween. In this aspect, the safety catch also includes a catch arm pivotally attached to each of the first support member and the second support member. The catch arm is positioned within the groove and is pivotable between a wedged position and a released position.

In another aspect, the invention is a water vessel arrangement for preventing rollback during launch or recovery operations. In this aspect, the invention includes a water vessel having a transom surface and at least one safety catch attached to the transom. The at least one safety catch includes a mounting bracket attached to the transom surface, and a first support member attached to the mounting bracket. The at least one safety catch also includes a second support member attached to the mounting bracket, with the first and second support members forming a groove therebetween. The at least one safety catch also includes a catch arm pivotally attached to each of the first support member and the second support member, with the catch arm positioned within the groove and pivotable between a wedged position and a released position.

In another aspect, the invention is an arrangement to prevent rollback on an inclined surface. The arrangement includes an inclined surface for launching or retrieving a water vessel, with the inclined surface having one or more notched grooves. In this aspect, each of the one or more notched grooves includes a first stop surface, a second stop surface, and a slide surface. The arrangement also include a water vessel having a transom surface, with the water vessel movably resting on the inclined surface. The arrangement further includes one or more safety catches attached to the transom, with each of the one or more safety catches aligned with one of the one or more notched grooves in the inclined surface. In this aspect, each safety catch includes a mounting bracket attached to the transom surface, and a first support member attached to the mounting bracket. Each safety catch also includes a second support member attached to the mounting bracket, with the first and second support members forming a groove therebetween. Each safety catch also includes a catch arm pivotally attached to each of the first support member and the second support member, the catch arm positioned within the groove and pivotable between a wedged position, extending fully into the notched groove, and a released position above the notched groove.

BRIEF DESCRIPTION OF THE DRAWINGS

Other features will be apparent from the description, the drawings, and the claims.

DETAILED DESCRIPTION

Figure 1A:
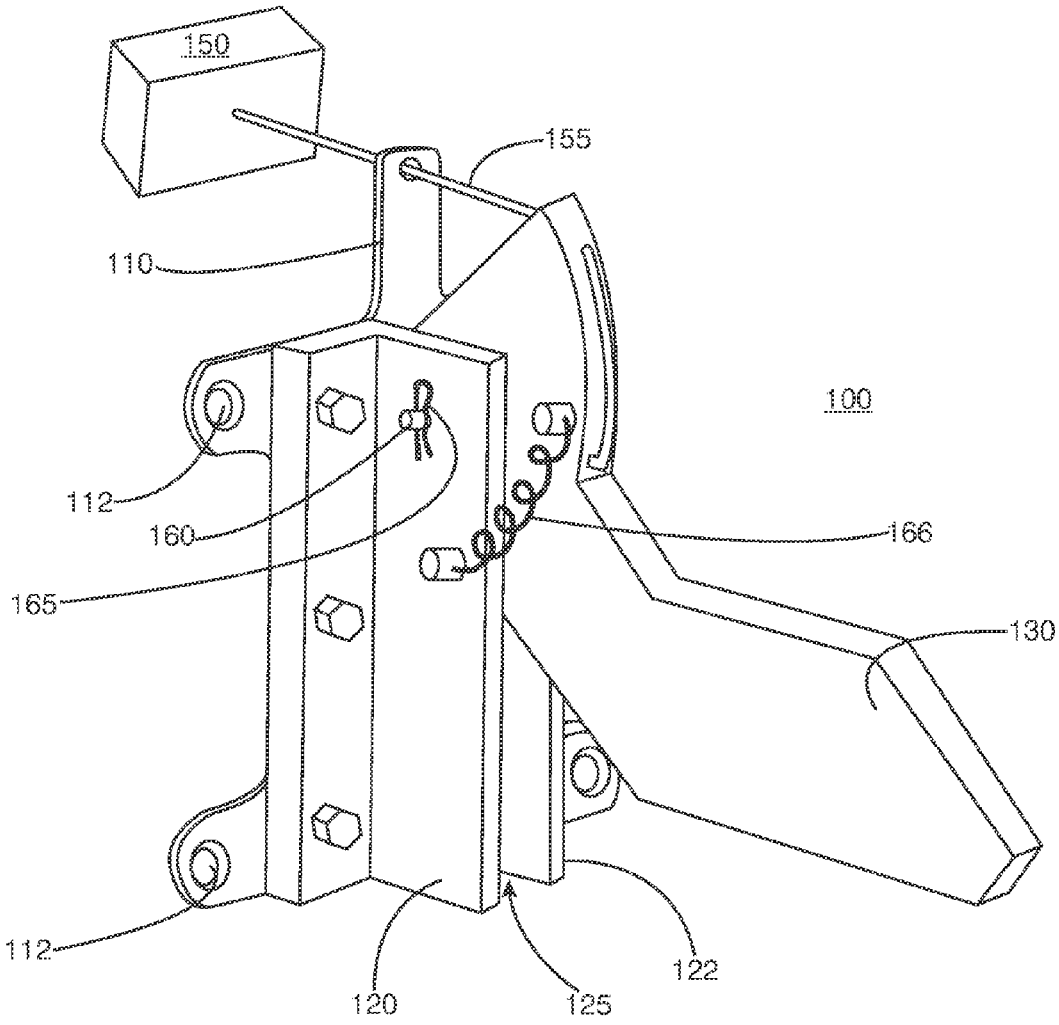
FIG. 1A is an exemplary illustration of a safety catch in a released position, according to an embodiment of the invention.
Figure 1B:
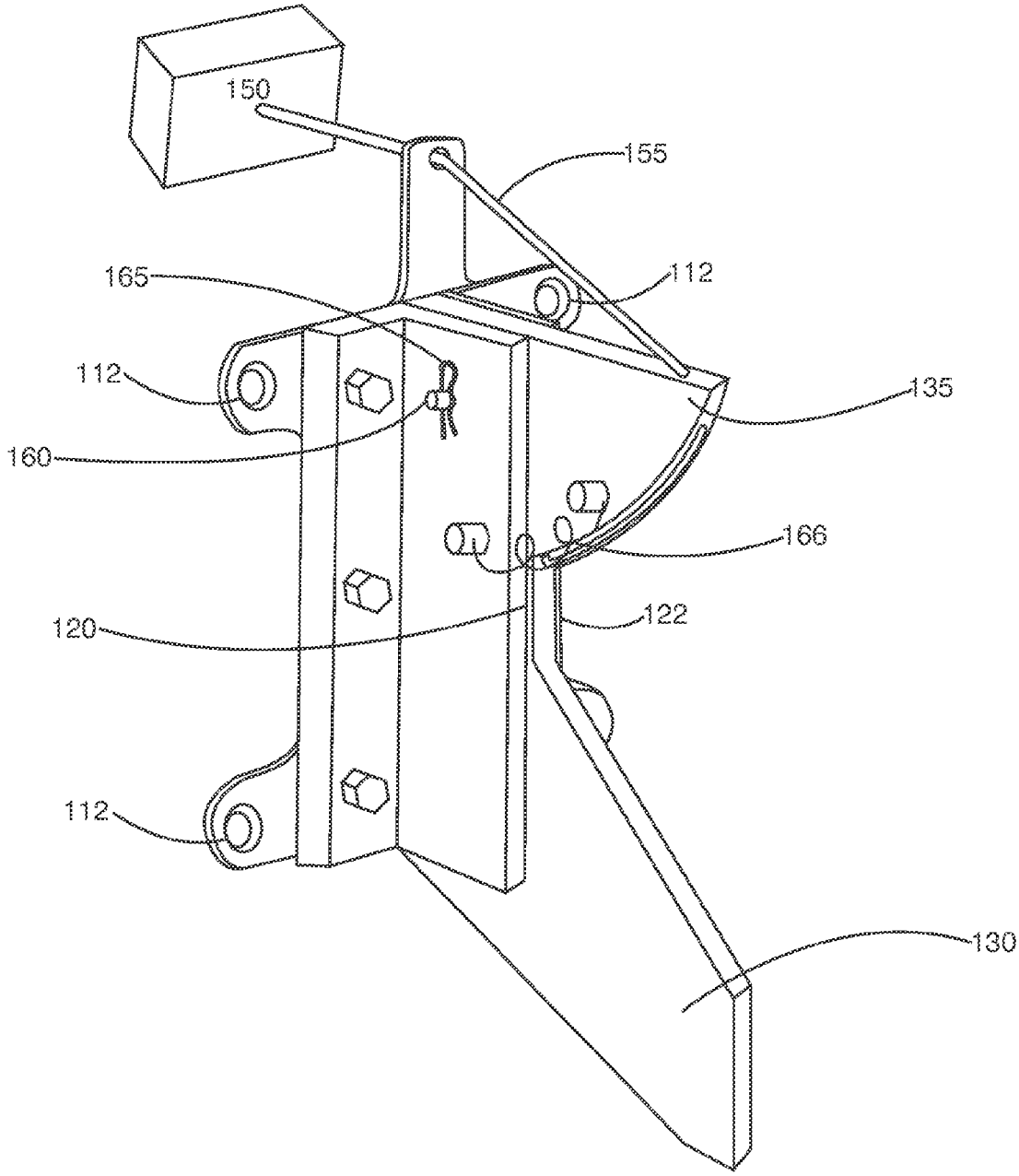
FIG. 1B is exemplary illustration of a safety catch in a wedged position, according to an embodiment of the invention.

FIGS. 1A and 1B are exemplary illustrations of a safety catch 100, according to an embodiment of the invention. As outlined below, one or more safety catches 100 may be attached to a water vessel, to prevent rollback during launch and recovery operations. As shown, the safety catch 100 includes a mounting bracket 110, which includes openings 112 for securing the safety catch 100 to a water vessel via fastening members such as bolts, screws, pins, rivets, and the like. FIGS. 1A and 1B also show a first support member 120 attached to the mounting bracket 110. As shown, the first support member 120 has a substantially L-shaped cross section. The safety catch 100 further includes a second support member 122, substantially identical to the first support member. The first and second support members 120 and 122 are positioned on the mounting bracket 110 in a symmetrical manner forming a groove 125 therebetween, as shown in FIG. 1A. The substantially L-shaped cross section of each support member 120 and 122 includes a backing plate that attaches to the mounting bracket, and an upright plate substantially perpendicular to the backing plate. The groove 125 is formed between the upright plates of support members 120 and 122.

The safety catch 100 further includes a catch arm 130. As shown, the catch arm 130 is positioned within the groove 125 formed between the support members 120 and 122. The catch arm 130 is suspended between the first and second support members 120, with a pivot link/bar 160 extending through upright plates of each of the first support member 120 and the second support member 122, and through the catch arm 130. This arrangement allows the catch arm 130 to pivot within the groove 125, between a released position shown in FIG. 1A and a wedged position shown in FIG. 1B. FIGS. 1A and 1B show a spring/biasing member 165 at a first protruding end of the pivot bar 160. A substantially identical spring may be positioned at the other end of the pivot bar 160 at the second support member 122. According to this embodiment, the springs 165 provide a default bias so that the catch arm 130 is biased towards the wedged position shown in FIG. 1B. The safety catch 100 may also include one or more additional tensioning members, spring 166, to provide additional biasing of the catch arm 130 towards the wedged position. Each spring 166 may be attached at one end to the catch arm 130, and at the other end to a support member 120 or 122.

FIGS. 1A and 1B also show a cable 155 attached to the upper lobe 135 of the catch arm 130. The cable 155 is drawn by an actuator 150, which may be manual or mechanized, such as a hydraulic arm. When drawn, the cable 155 pivots the catch arm 130 away from the wedged position shown in FIG. 1B towards a released position. As outlined below, the catch arm 130 of the device is typically held in the released position during launch and recovery operations. When required to prevent rollback, the actuator 150 disengages and catch arm 130 moves to the wedged position shown in FIG. 1A.

Figure 2A:
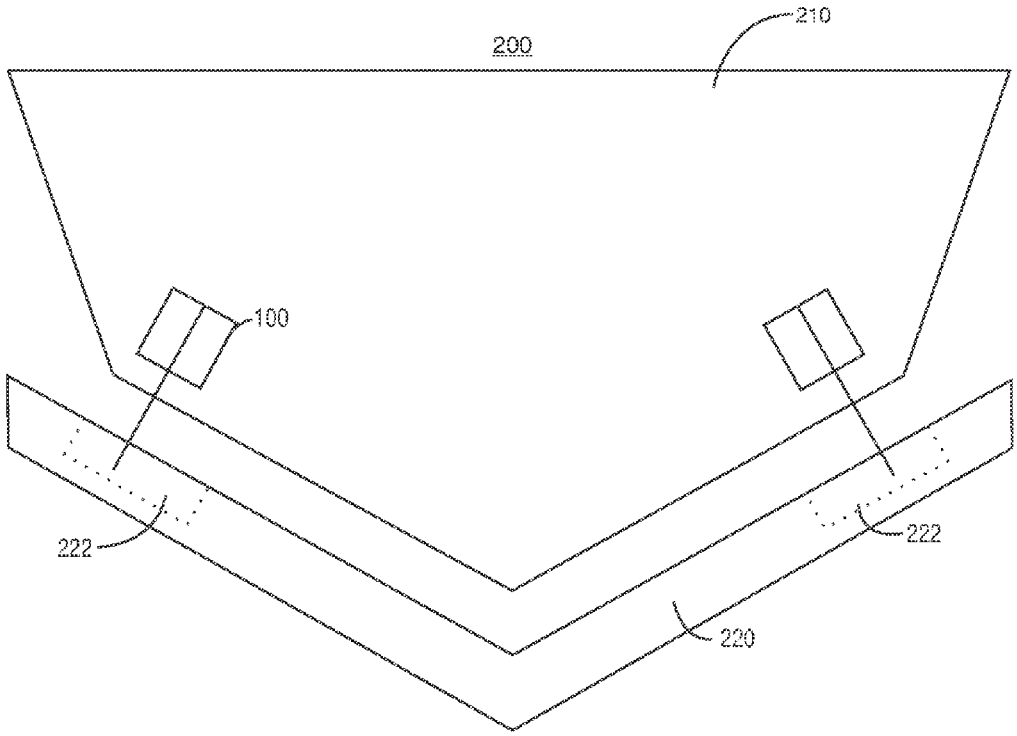
FIG. 2A is an exemplary rear-view sectional illustration of a water vessel on an inclined surface, including a safety catch arrangement and a corresponding notched groove on the inclined surface, according to an embodiment of the invention.
Figure 2B:
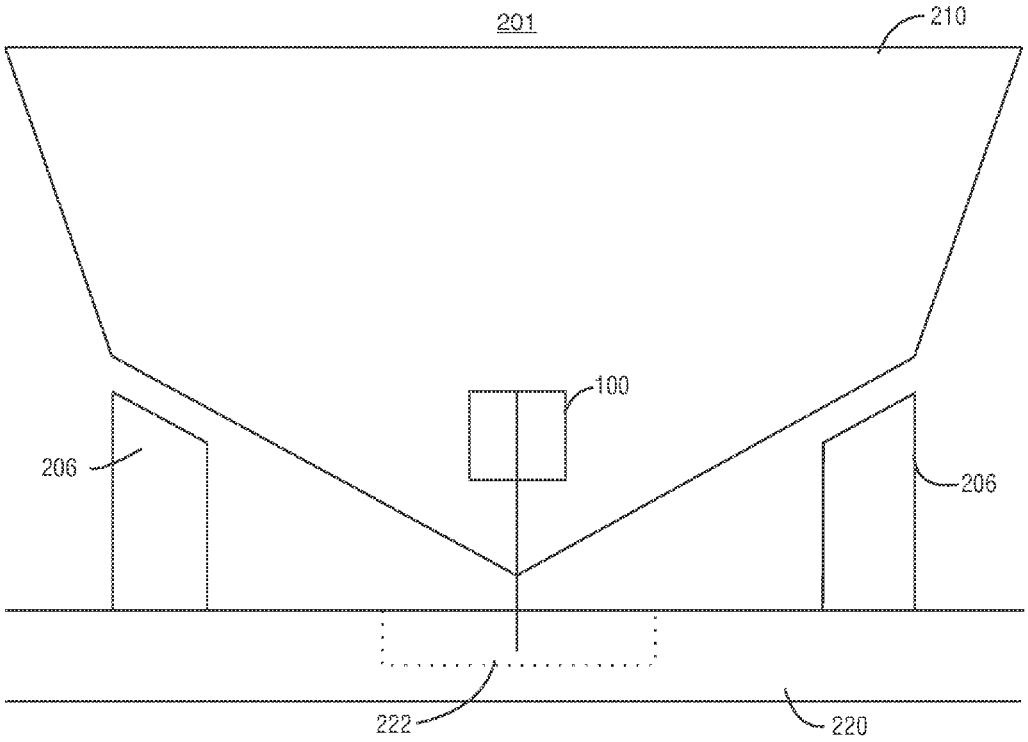
FIG. 2B is an exemplary rear-view sectional illustration of a water vessel on an inclined surface, including a safety catch arrangement and a corresponding notched groove on the inclined surface, according to an embodiment of the invention.
Figure 2C:
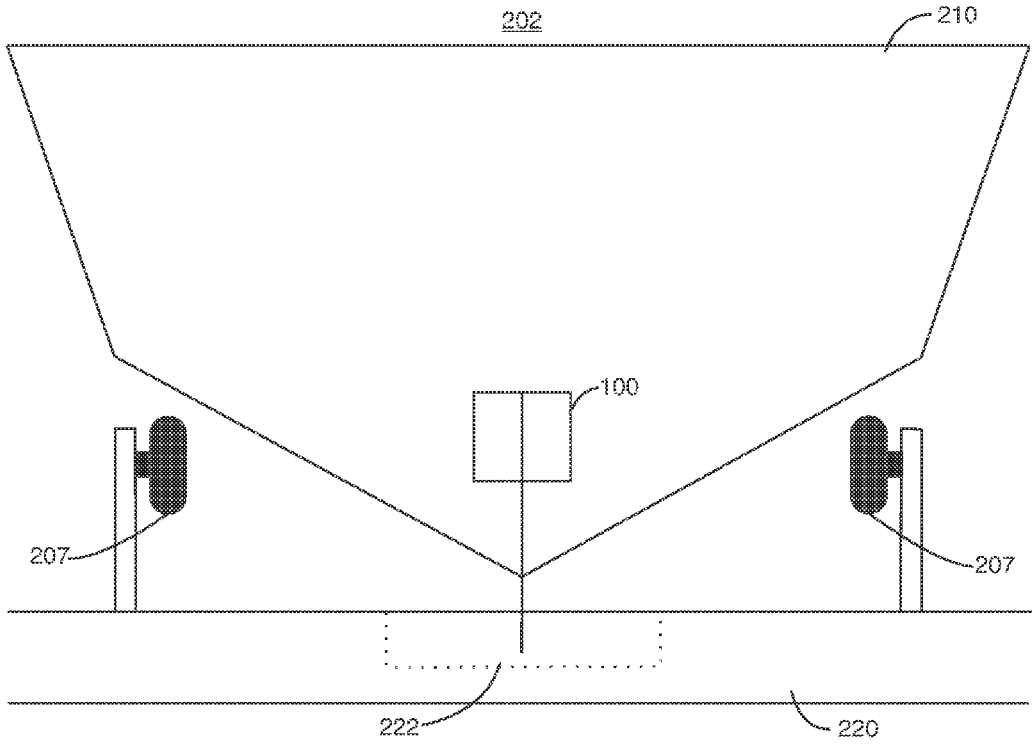
FIG. 2C is an exemplary rear-view sectional illustration of a water vessel on an inclined surface, including a safety catch arrangement and a corresponding notched groove on the inclined surface, according to an embodiment of the invention.

FIGS. 2A-2C show exemplary rear-view sectional illustrations of arrangements 200, 201, and 202, respectively, including a water vessel 210 positioned on an inclined surface 220. Typically, the water vessel 210 is on the inclined surface 220 undergoing a launch or recovery operation. The inclined surface 210 may be a ramp that is attached to a parent ship, from which the water vessel 210 is launched, or to which the water vessel 210 is received. Alternatively, the ramp may be attached to another floating structure, a trailer, or to land-based infrastructure. The water vessel 210 may be a manned or unmanned boat.

In arrangement 200, as shown in FIG. 2A, the inclined surface 220 has a cradled design to properly support the water vessel 210. Thus, when designed for receiving for water vessels 210 having for example, a substantially V-shaped hull underside, the inclined surface 220 may be a ramp having a corresponding substantially V-shaped cradle design, as shown in FIG. 2A. The surface 220 may be a smooth slick surface made of, for example, ultra-high molecular weight polyethylene. According to the arrangement 200 shown in FIG. 2A, the water vessel 210 includes two safety catches 100 attached to the transom of the vessel 210. As shown, the safety catches 100 are located at extreme ends of the transom, with a first safety catch 100 located towards the portside edge, and a second safety catch 100 towards the starboard edge. This design with safety catches 100 positioned at extreme ends of the transom accommodates for water vessels 210 having single or double engine propulsion devices.

Figure 3A:
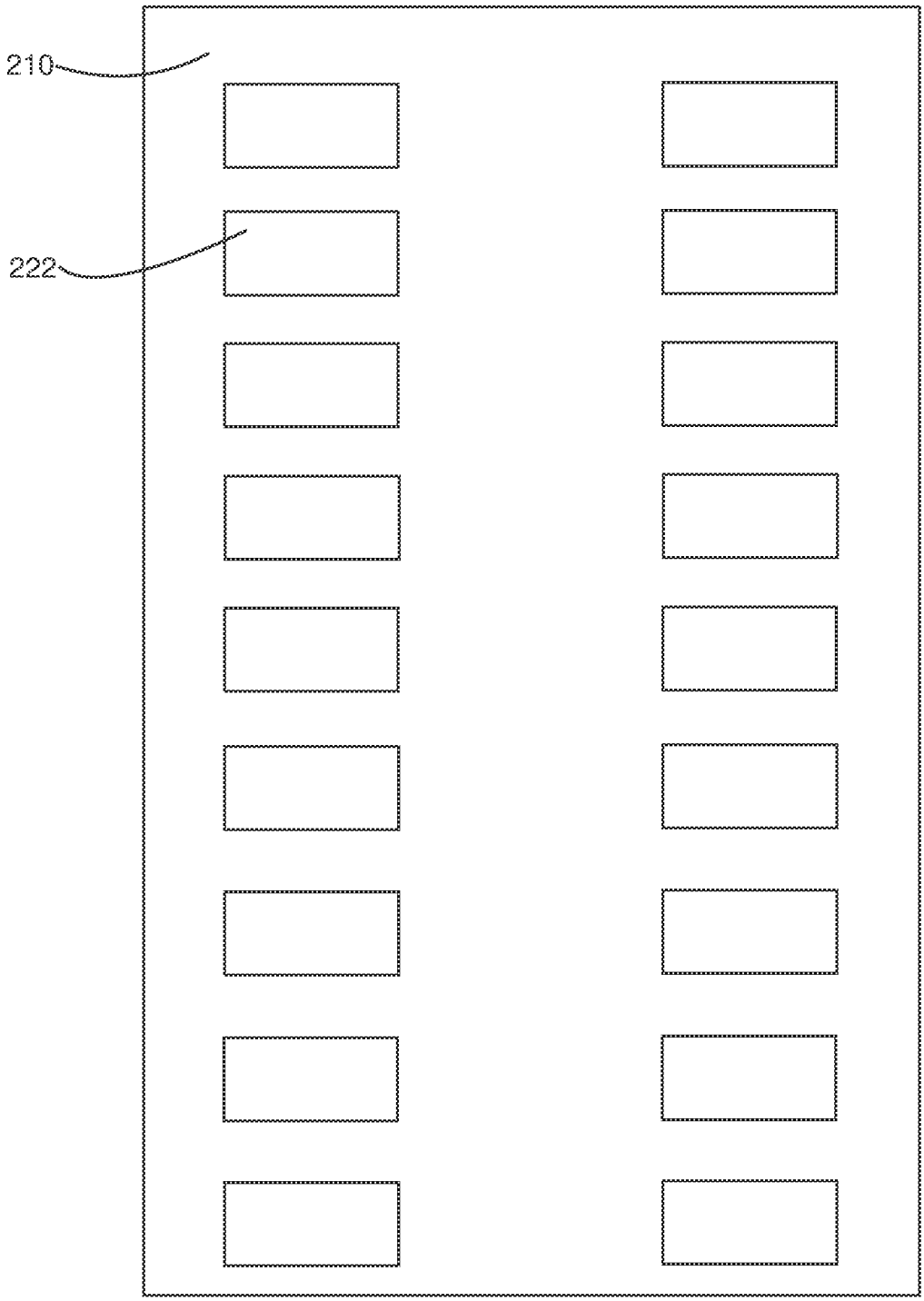
FIG. 3A is a top view showing the arrangement of grooves along an inclined surface, according to the embodiment of FIG. 2A.

FIG. 2A shows the inclined surface 220 having grooved notches 222 within the surface. As illustrated, each grooved notch 222 is aligned with a safety catch 100, so that a catch arm 130 may extend into the notched groove 222. FIG. 3A is a top view showing the arrangement of notched grooves 222 along the inclined surface 220, according to the arrangement 200 of FIG. 2A. FIG. 3A shows nine pairs of notched grooves 222 along the length of the inclined surface 220. However, it should be noted that arrangement 200 may include more than nine pairs or less than nine pairs, so long as the amount of grooves are sufficient to retard the downward movement of the water vessel 210, preventing the buildup of overwhelming uncontrolled downward momentum. The grooved notch 222 may be wide enough and spaced apart to accommodate for water vessels 210 having different sized beams. Thus water vessels having larger or smaller beams than the water vessel 210 illustrated in FIG. 2A may also be compatible with the notched grooves 222 shown in FIG. 2A. Additionally, the elongated widths of the grooves 222 accommodate for water vessels that are not centered on the inclined surface 220. As outlined below, the structure of the safety catches 100 in combination with correlating notched grooves 222 prevent rollback of the water vessel 210 down the inclined surface 220, thereby avoiding harm to personnel, and damage to equipment.

FIG. 2B shows an exemplary rear-view sectional illustration of an arrangement 201, similar to the arrangement 200 of FIG. 2A. FIG. 2B shows a water vessel 210 positioned on an inclined surface 220. The inclined surface 220 of arrangement 201 may be a substantially planar ramp having a bunk board pair 206, along the length of the ramp. The bunk board pair 206 is for supporting the hulls of different water vessels 210, and as shown, run length-wise to the water vessel 210. Each bunk board 206 may be covered with a material such as cloth or plastic that allows the water vessel 210 to freely glide during launch and recovery operations. The arrangement 201 includes only one safety catch 100 attached to the transom of the water vessel 210. As shown, the safety catch 100 is attached to a central portion of the transom, about midway between the portside edge and the starboard edge of the transom. Similar to the arrangement 200 of FIG. 2A, the arrangement 201 includes a notched groove 222 that is aligned with the safety catch 100 on the water vessel 210, so that a catch arm 130 may extend into the notched groove 222.

Figure 3B:
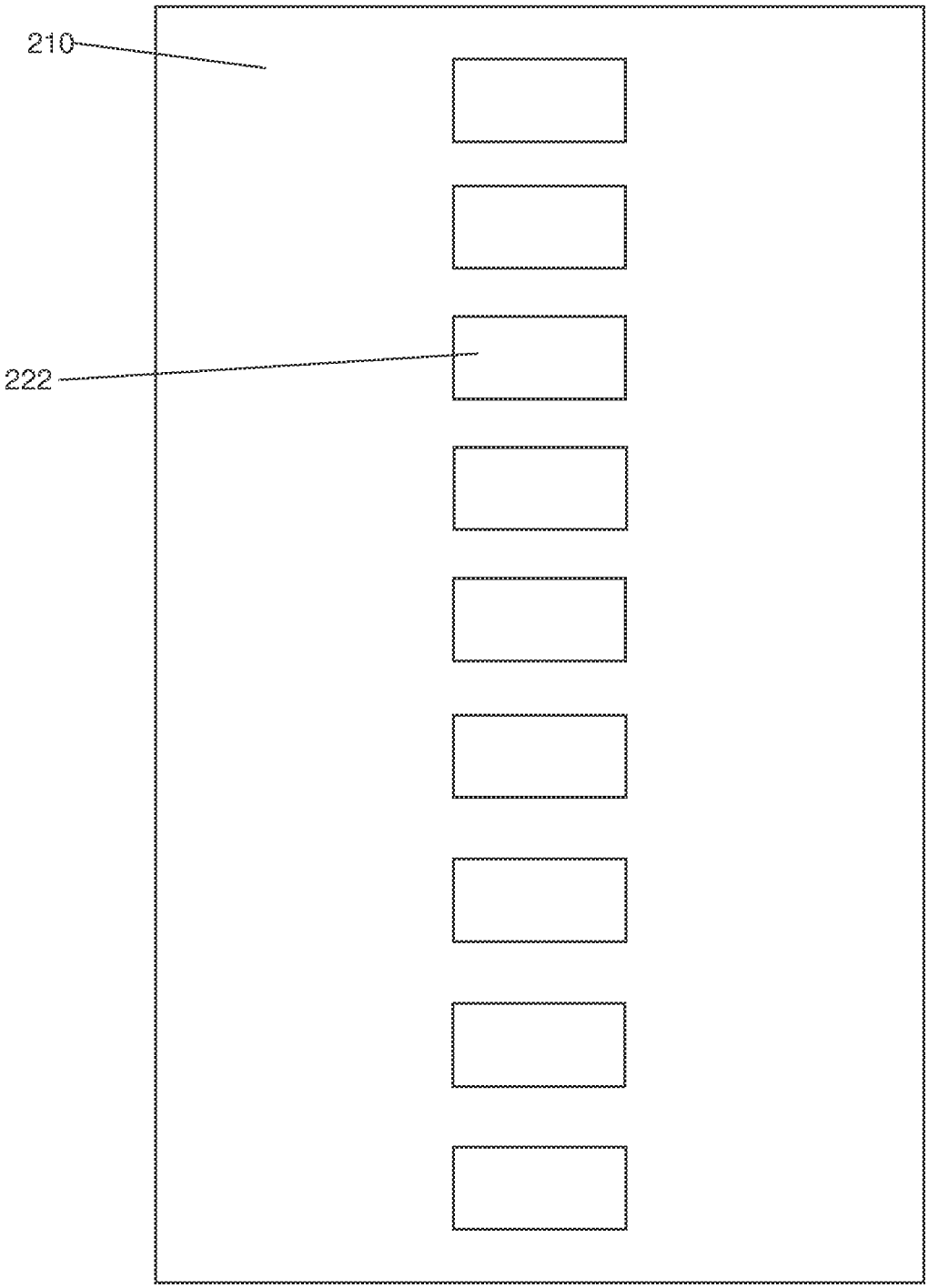
FIG. 3B is a top view showing the arrangement of grooves along an inclined surface, according to the embodiments of FIG. 2B and FIG. 2C.

FIG. 3B is a top view showing the arrangement of notched grooves 222 along the inclined surface 220, according to the arrangement 201 of FIG. 2B. As illustrated, the notched grooves are located at a central location of the ramp. Although FIG. 3B shows nine notched grooves 222, arrangement 201 may include more than nine or less than nine notched grooves 222, so long as the amount of grooves are sufficient to retard the downward movement of the water vessel 210, preventing the buildup of overwhelming uncontrolled downward momentum. The width of the notched groove 222 may be wide enough to accommodate for water vessels of different beams and for water vessels that are not properly centered on the inclined surface 220.

FIG. 2C shows an exemplary rear-view sectional illustration of an arrangement 202, similar to the arrangement 201 of FIG. 2B. The arrangement 202 also includes an inclined surface 220. However, as opposed to bunk boards 206, arrangement 202 includes a plurality of wheels 207 mounted on wheel supports 208, for supporting the water vessels 210 thereon. The wheels 207 are symmetrically arranged in pairs to provide support to a water vessel 210, with a central hull portion of the vessel is positioned substantially midway between each wheel pair. Similar to arrangement 201, the arrangement 202 includes one safety catch 100 attached to the transom of the water vessel 210, attached to a central portion of the transom, about midway between the portside edge and the starboard edge of the transom. The arrangement 202 also includes a notched groove 222 that is aligned with the safety catch 100 on the water vessel 210, so that a catch arm 130 may extend into the notched groove 222. FIG. 3B is a top view showing the arrangement of notched grooves 222 along the inclined surface 220, according to the arrangement 201 of FIG. 2B. As illustrated, the notched grooves are located at a central location of the ramp. As outlined above, although FIG. 3B shows only nine notched grooves 222, arrangement 202 may include more than nine or less than nine notched grooves 222, so long as the amount of grooves are sufficient to retard the downward movement of the water vessel 210, preventing the buildup of overwhelming uncontrolled downward momentum.

It should be noted that although FIG. 2A shows the water vessels 210 having two safety catches 100, the arrangement may have one safety catch or more than two safety catches. Similarly, although FIGS. 2B and 2C show water vessels 100 having a single safety catch, the water vessels 210 may have more than one safety catch. Whatever the number and arrangement of safety catches 100, the inclined surface 220 is provided with the corresponding matching number of notched grooves 222.

Figure 2D:
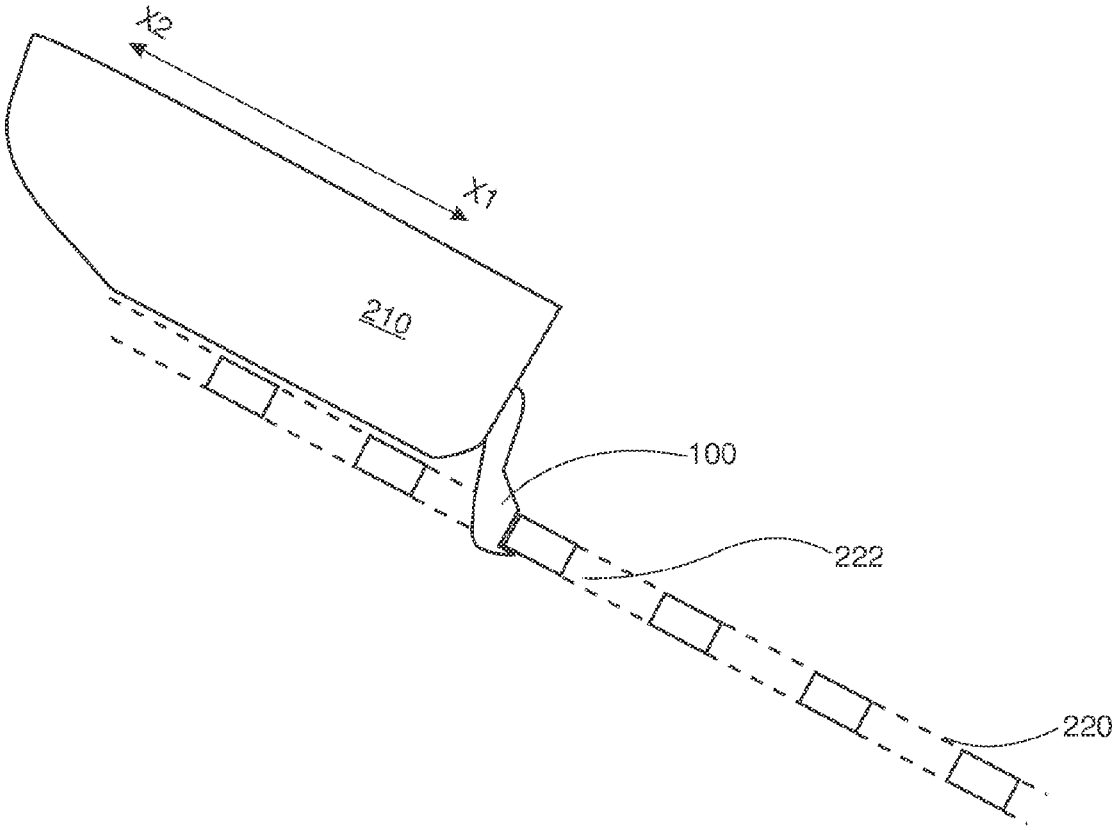
FIG. 2D is an exemplary side-view sectional illustration of a water vessel having an engaged safety catch preventing rollback, according to an embodiment of the invention.
Figure 2E:
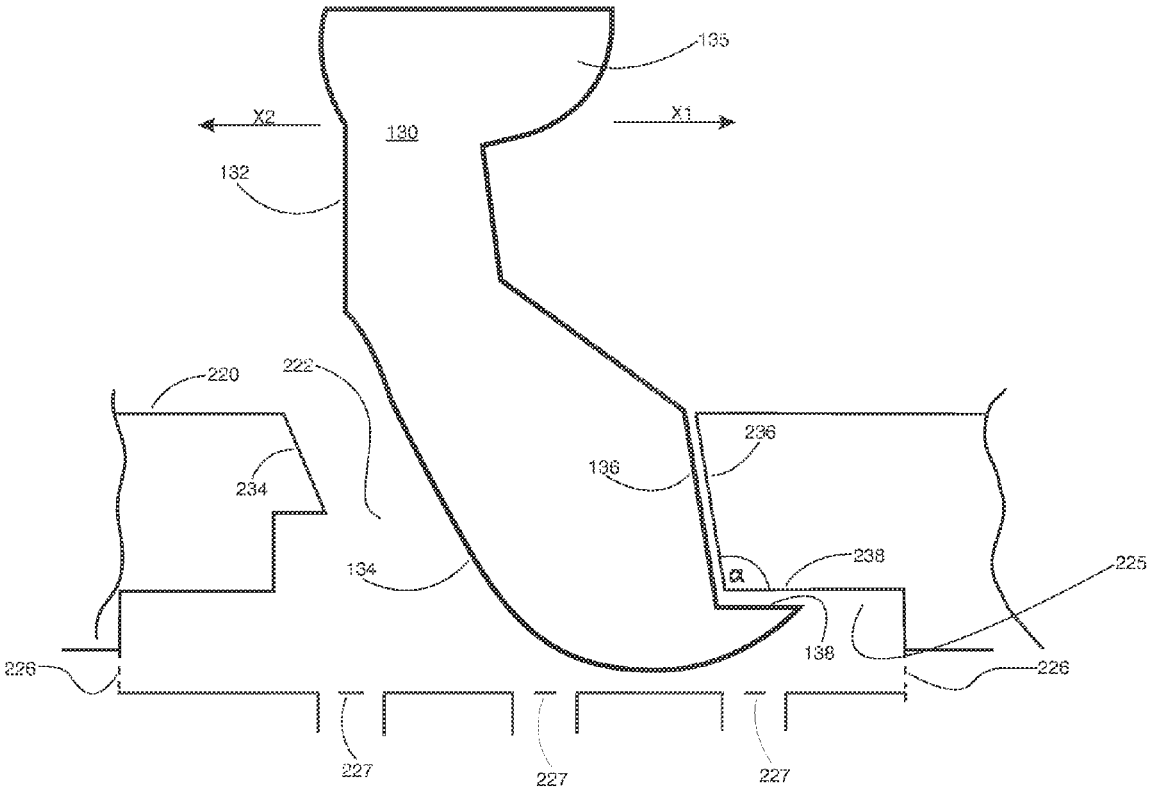
FIG. 2E is an exemplary sectional illustration of the relationship between the catch arm and the notched groove, according to an embodiment of the invention.

FIG. 2D is an exemplary side-view sectional illustration of a water vessel 210 having an engaged safety catch 130 preventing rollback, according to an embodiment of the invention. As shown, because the catch arm 130 of the safety catch 100 is wedged in the notched groove, movement (rollback) in direction $X_1$ is prevented. FIG. 2E is an exemplary sectional illustration of the relationship between catch arm and notched groove, when the catch arm 130 is wedged as shown in FIG. 2D. As shown, the catch arm 130 is an angular arm having several distinct surfaces. FIG. 2E shows the catch arm having a support surface 132, which as outlined below, lies against and is supported by the mounting bracket 110 when the catch arm 130 is in a wedged position. The support surface 132 is substantially planar. FIG. 2E also shows the catch arm 130 having a slide surface 134, which is curved. The curved shape predisposes the slide surface 134 to slide against the corresponding notched groove surface. The catch arm 130 also includes first and second stop surfaces 136 and 138, both substantially planar, which serve to lock the catch arm 130 in the notched groove 222. The second stop surface 138 is substantially perpendicular to the support surface 132.

FIG. 2E also shows the notched groove 222, having several corresponding surfaces for mating with the different angled surfaces of the catch arm 130. As shown, the notched groove 222 includes a slide surface 234, a first stop surface 236, and a second stop surface 238. As shown in FIG. 2E, the first stop surface 236 of the notch 222 is slanted at an angle $\alpha$ with respect to second stop surface 238, which is an obtuse angle, which is commensurate with corresponding notch surfaces. As outlined below, during launch and recovery operations, the slide surface of the catch arm 130 may slide over the slide surface of the notched groove 222. The angled orientation of the slide surface 134 facilitates this sliding. The first and second stop surfaces 136 and 138 of the catch arm 130 lock against the first and second lock surfaces 236 and 238 of the notched groove 222, thereby providing an emergency brake and preventing rollback of the water vessel 200. The notched groove 222 also includes a cavity area 225 below the mating surfaces. The cavity area may include several outlets 226 and 227 providing outlet drainage for water, sand, and other debris.

In operation, when the water vessel 210 moves in direction $X_2$, the actuator 250 maintains the catch arm 130 in the released position so that the catch arm 130 moves without making contact with the inclined surface 220. However, if the catch arm 130 is in the wedged position as shown in FIG. 1B when the water vessel 200 is moving in direction $X_2$, the slide surface 134 of the catch arm 130 slides along the slide surface 234 of the notched groove. When the water vessel slips in direction $X_1$, the actuator 250 withdraws, and because of the biasing as outlined above, the catch arm 130 has a spring tensioner to keep catch arm 130 pushed down and thus allows stop surfaces 136 and 236 to engage each other. Because of the slant angle $\alpha$, the engagement between first stop surfaces 136 and 236 is secure, and the catch arm 130 does not climb out of the notch or suffer disengagement. This prevents the water vessel 210 from sliding downwards and the catch arm 130 moves to the wedged position and enters into the notched groove 222. The catch arm 130 would also enter the notched groove 222 if the catch arm 130 was in the wedged orientation prior to slipping in direction $X_1$. When in the groove, the forces of gravity and the weight of the water vessel 210 pushes the first stop surface 136 of the catch arm 130 against the first stop surface 236 of the notched groove 222. Because of the weight of the water vessel 210 and because of the angled connection between first and second stop surfaces 136 and 138, the second stop surface 138 of the catch arm 130 may also engage the second stop surface 238 of the notched groove 222, locking the catch arm 130 in the position shown. This results in holding the water vessel 200 at the locked location along the inclined surface 220, preventing rollback and the related adverse consequences of rollback.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A water vessel arrangement for preventing rollback during launch or recovery operations, comprising:

a water vessel having a transom surface;

at least one safety catch attached to the transom surface, wherein the at least one safety catch comprises:

a mounting bracket attached to the transom surface;

a first support member attached to the mounting bracket;

a second support member attached to the mounting bracket, the first and second support members forming a groove therebetween;

a catch arm pivotally attached to each of the first support member and the second support member, the catch arm positioned within the groove and pivotable between a wedged position and a released position, the catch arm further comprising a planar support surface for supporting the catch arm against the mounting bracket when the catch is in the wedged position, and a curved slide surface connected to the support surface for sliding along a notched groove surface; and one or more biasing springs connected to the catch arm for biasing the catch arm towards the wedged position.

2. The water vessel of claim 1, wherein in each of the at least one safety catch, the catch arm further comprises:

a first planar stop surface for locking the safety catch against a notched groove surface;

a second planar stop surface connected to the first planar stop surface at an obtuse angle, for locking the safety catch against a notched groove surface, wherein the second planar stop surface is substantially perpendicular to the planar support surface.

3. The water vessel of claim 2, wherein each of the first and second support members of the at least one safety latch have a substantially L-shaped configuration comprising:

a backing plate; and an upright plate substantially perpendicular to the backing plate, and, wherein the backing plate of each of the first and second support members is attached to the mounting bracket, and wherein the groove is formed between the upright plates of the first and second support members, the safety catch further including a pivot link attached to each of the first and second upright plates, wherein the pivot link extends through the catch arm allowing for the pivoting of the catch arm within the groove.

4. The water vessel of claim 3, wherein each at least one safety catch further comprises:

an actuator cable attached to the catch arm for moving the catch arm from the wedged position to the released position.

5. The water vessel of claim 4, wherein the at least one safety catch comprises a first safety catch and a second safety catch, wherein the first safety catch is attached towards a port side of the transom surface and the second safety catch is attached towards a starboard side of the transom surface.

6. The water vessel of claim 4, wherein the at least one safety catch comprises a first safety catch positioned at central portion of the transom surface.

7. An arrangement to prevent rollback on an inclined surface, the arrangement comprising:

an inclined surface for launching or retrieving a water vessel, the inclined surface having one or more notched grooves, each of the one or more notched grooves comprising:

a first stop surface;

a second stop surface; and a slide surface;

a water vessel having a transom surface, the water vessel movably resting on the inclined surface;

one or more safety catches attached to the transom surface, each of the one or more safety catches aligned with one of the one or more notched grooves in the inclined surface, wherein each safety catch comprises:

a mounting bracket attached to the transom surface;

a first support member attached to the mounting bracket;

a second support member attached to the mounting bracket, the first and second support members forming a groove therebetween;

a catch arm pivotally attached to each of the first support member and the second support member, the catch arm positioned within the groove and pivotable between a wedged position extending fully into the notched groove and a released position above the notched groove.

8. The arrangement to prevent rollback of claim 7, wherein in each of the one or more safety catches, the catch arm comprises:

a planar support surface for supporting the catch arm against the mounting bracket when the catch is in the wedged position;

a curved slide surface connected to the support surface for sliding along a notched groove surface;

a first planar stop surface for locking the safety catch against a notched groove surface;

a second planar stop surface connected to the first planar stop surface at an obtuse angle, for locking the safety catch against a notched groove surface, wherein the second planar stop surface is substantially perpendicular to the planar support surface.

9. The arrangement to prevent rollback of claim 8, wherein each of the first and second support members of the one or more safety latches have a substantially L-shaped configuration comprising:

a backing plate; and an upright plate substantially perpendicular to the backing plate, and, wherein the backing plate of each of the first and second support members is attached to the mounting bracket, and wherein the groove is formed between the upright plates of the first and second support members, the safety catch further including a pivot link attached to each of the first and second upright plates, wherein the pivot link extends through the catch arm allowing for the pivoting of the catch arm into a respective notched groove.

10. The arrangement to prevent rollback of claim 9, wherein each of the one or more safety catches further comprises:

one or more biasing springs connected to the pivot link for biasing the catch arm towards the wedged position; and an actuator cable attached to the catch arm for moving the catch arm from the wedged position to the released position.

11. The arrangement to prevent rollback of claim 10, wherein each of the one or more notched grooves comprises a cavity therewithin having a plurality of drainage outlets for draining debris from the notched grooves.

12. The arrangement to prevent rollback of claim 11, wherein the one or more safety catches comprise a first safety catch and a second safety catch, wherein the first safety catch is attached towards a port side of the transom surface and the second safety catch is attached towards a starboard side of the transom surface, and wherein the one or more notched grooves comprise a first notched groove at a position that corresponds to the first safety catch, and a second notched groove at a position that corresponds to the second safety catch.

13. The arrangement to prevent rollback of claim 11, wherein the one or more safety catches comprise a first safety catch positioned at central portion of the transom surface, and wherein the one or more notched grooves comprise a first notched groove at a position that corresponds to the first safety catch.

* * * * *